United States Patent [19]

Kawamura et al.

[11] Patent Number: 4,616,593

[45] Date of Patent: Oct. 14, 1986

[54] PAINT SUPPLY APPARATUS FOR ROTARY PAINTING MACHINE

[75] Inventors: Kaoru Kawamura; Yuichi Iwaki, both of Toyama, Japan

[73] Assignee: Yoshida Kogyo K. K., Tokyo, Japan

[21] Appl. No.: 775,235

[22] Filed: Sep. 12, 1985

[30] Foreign Application Priority Data

Sep. 19, 1984 [JP] Japan ..... 59-196137

[51] Int. Cl.[4] ..... B05B 7/02

[52] U.S. Cl. ..... 118/303; 118/313; 118/321; 118/323; 239/305

[58] Field of Search ..... 427/421; 118/313, 320, 118/321, 323, 301, 303; 239/305

[56] References Cited

U.S. PATENT DOCUMENTS

| | | | |
|---|---|---|---|
| 2,610,578 | 9/1952 | Paasche | 118/313 |
| 3,379,377 | 4/1968 | Ripple | 118/323 X |
| 3,674,207 | 7/1972 | Carbonetti, Jr. et al. | 239/305 |
| 4,311,111 | 1/1982 | Inaba | 118/56 |
| 4,433,796 | 2/1984 | Brooks | 239/305 |

*Primary Examiner*—Shrive P. Beck

*Attorney, Agent, or Firm*—Hill, Van Santen, Steadman & Simpson

[57] ABSTRACT

In a rotary painting machine having a number of angularly spaced barrels rotatably mounted on an indexing turntable for receiving parts to be painted and a painting station into which each of the barrels is capable of being indexed by rotating the turntable, an apparatus for supplying paint to the rotary pointing machine includes painting spray guns of a number equivalent to the number of barrels. The spray guns are arrayed in spaced side-by-side relation adjacent the painting station and are capable of being transversely reciprocated in unison to shift a predetermined spray gun into opposition with whichever of the barrels is located in the painting station, thereby allowing the batch of parts in each barrel to be sprayed with a paint prescribed for said batch.

2 Claims, 5 Drawing Figures

PAINT SUPPLY APPARATUS FOR ROTARY PAINTING MACHINE

BACKGROUND OF THE INVENTION

1. Field of the Invention

This invention relates to a paint supply apparatus in a rotary painting machine having a number of barrels in which parts to be painted are introduced, with the parts in each barrel being coated with paint of a different color or type.

2. Prior Art

A painting machine of the above-described type generally is used to paint small metal parts such as the slider, top end stop and bottom end stop of a slide fastener, as well as buttons and hooks. The painting process includes introducing the parts into a barrel made of wire mesh, spray-coating the parts with paint ejected from a spray gun, drying the paint coating at room temperature to set the coating, then baking, drying and cooling the coating. A sequence of these steps is repeated a plurality of times, usually four or five. An example of such a painting machine is disclosed in the specification of Japanese Patent Publication No. 58-5107 (U.S. Pat. No. 4,311,111). The disclosed painting apparatus has three radially extending barrels arranged in angularly spaced relation and capable of being rotated about their own axes and revolved around a common central axis. The parts placed in the barrels are capable of being coated with paint of only a single color. When it is desired to change the color of the paint applied by the painting machine, it is necessary to clean the barrels, change the spraying device equipped with the spray gun and adjust both the paint spray pressure and the spraying time. Thus, changing the color of the paint necessitates a time-consuming operation. Though a single painting machine is sufficient when utilized to apply a single color, the application of a plurality of colors requires the installation of an equivalent number of painting machines. The result is a costly set-up requiring a large amount of space.

SUMMARY OF THE INVENTION

The object of the present invention is to provide a paint supply apparatus in a rotary painting machine of the type having a number of radially extending and angularly spaced barrels, which apparatus is adapted to repeatedly supply each individual barrel with a prescribed paint to coat the parts accommodated in the barrels with paint that differs in color or in type from one barrel to another, whereby large numbers of painted parts differentiated by paint color or type can be obtained at one time.

According to the present invention, the foregoing object is attained by providing a paint supply apparatus in a rotary painting machine having a number of barrels and including a painting station into which each of the barrels is capable of being indexed. The apparatus includes spray guns, the number of which is equivalent to the number of barrels, arranged in spaced side-by-side relation adjacent the location of the painting station. Means are provided for intermittently shifting the spray guns while maintaining their side-by-side relationship to bring a desired one thereof into opposition with the barrel situated in the painting station.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The drawings illustrate a paint supply apparatus for a rotary painting machine according to the present invention, in which.

DETAILED DESCRIPTION

Figure 1:
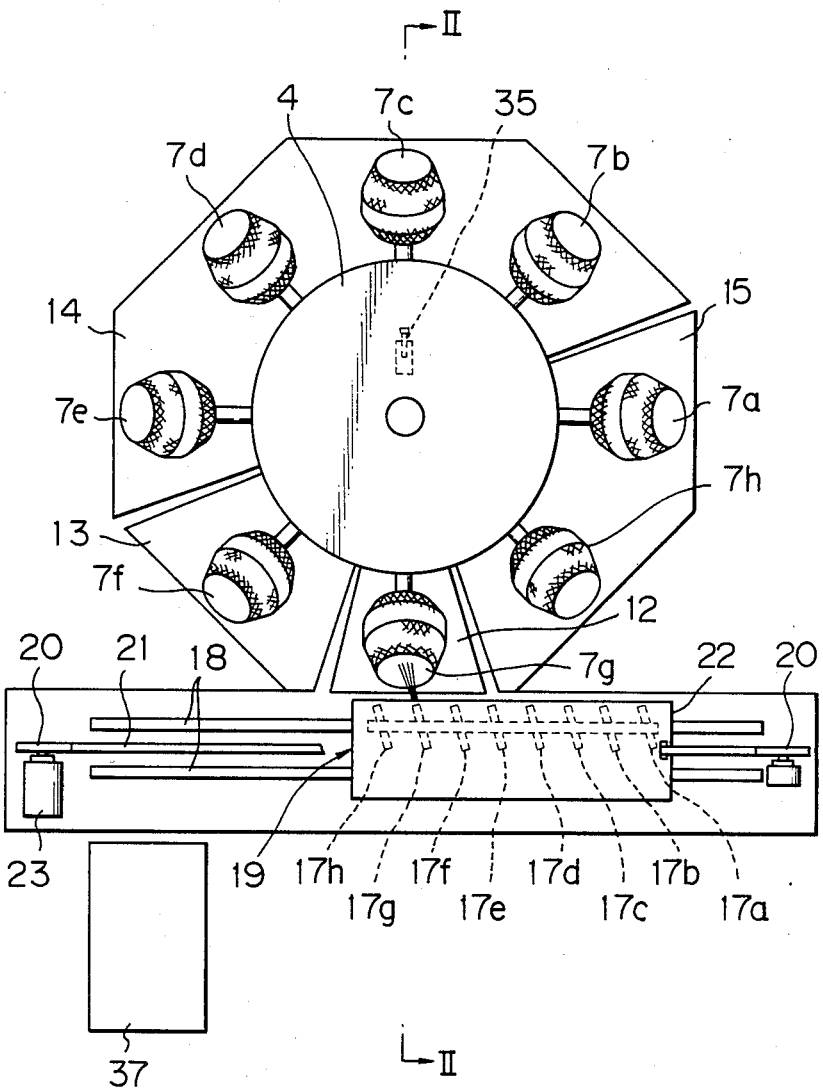
FIG. 1 is a plan view showing both the paint supply apparatus and the rotary painting machine.
Figure 2:
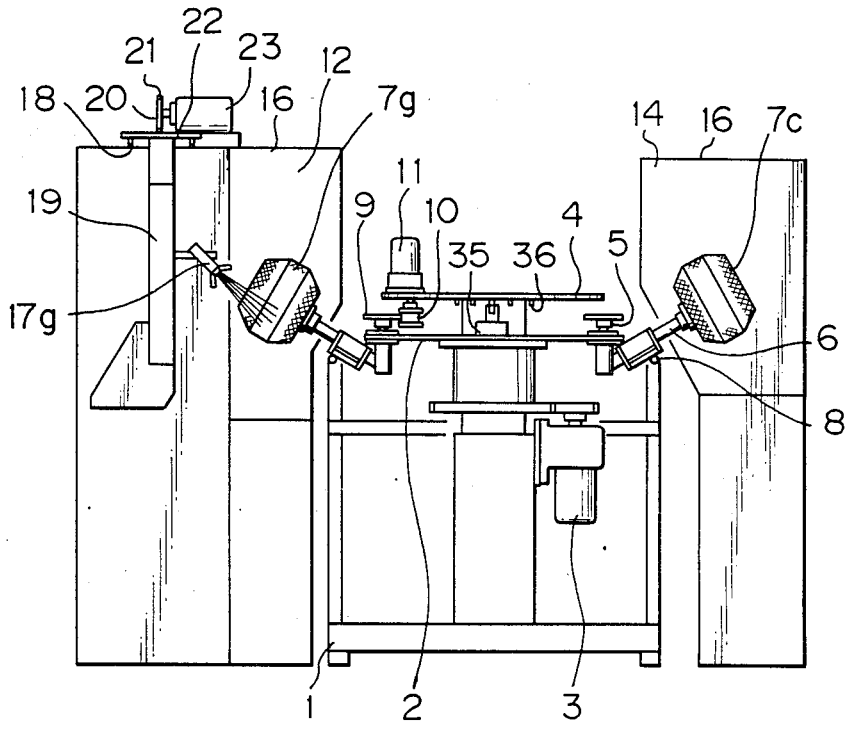
FIG. 2 is a sectional view taken along line II—II of FIG. 1.

As shown in FIGS. 1 and 2, a rotary painting machine to which the paint supply apparatus of the present invention can be applied includes a circular frame 1, a horizontal turntable 2 rotatably mounted on the frame 1 at the center thereof, a first motor 3 supported on the frame 1 for intermittently rotating the turntable 2, and a horizontal stationary table 4 supported on the frame 1 above the turntable 2. The turntable 2 is provided with eight equally angularly spaced pivot shafts 5 having upper and lower ends protruding from the turntable. Coupled to the lower end of each pivot shaft 5 via a bevel gear (not shown) is the lower end of a rotary shaft 6 inclined upwardly from the lower end of the corresponding pivot shaft 5. Barrels 7*a* through 7*h* made of wire mesh are fixedly secured to the upper ends of respective ones of the rotary shafts 6. The frame 1 has an upper end equipped with an annular rail 8 on which the shafts 6 are rollingly supported. Attached to the upper end of each pivot shaft 5 is a sprocket 9. A pin gear 10 brought into mesh with sprocket 9 by rotation of the turntable 2 is provided on the underside of the stationary table 4 so as to be rotated by a corresponding second motor 11 supported on the stationary table 4.

As the turntable 2 is rotated, the radially extending barrels 7*a* through 7*h* revolve with the turntable about a common central axis. Revolution is intermittent, with each angular increment of movement being equivalent to the spacing between adjacent barrels. When the sprocket 9 meshes with the pin gear 10 owing to revolution of the turntable 2, the corresponding barrel is rotated about its own axis by the second motor 11 via the pin gear 10. Each second motor 11 is provided on the stationary table 4 at a position to which a barrel is indexed by the turntable 2.

Disposed around the turntable in spaced angular relation are a painting station 12, a setting station 13 for room-temperature drying, a baking and drying station 14 and a cooling station 15, each of which is covered by a corresponding box-like cover 16. The painting station 12 and setting station 13 are capable of accommodating one barrle each, the baking and drying station 14 four barrels, and the cooling station 15 one barrel.

Figure 3:
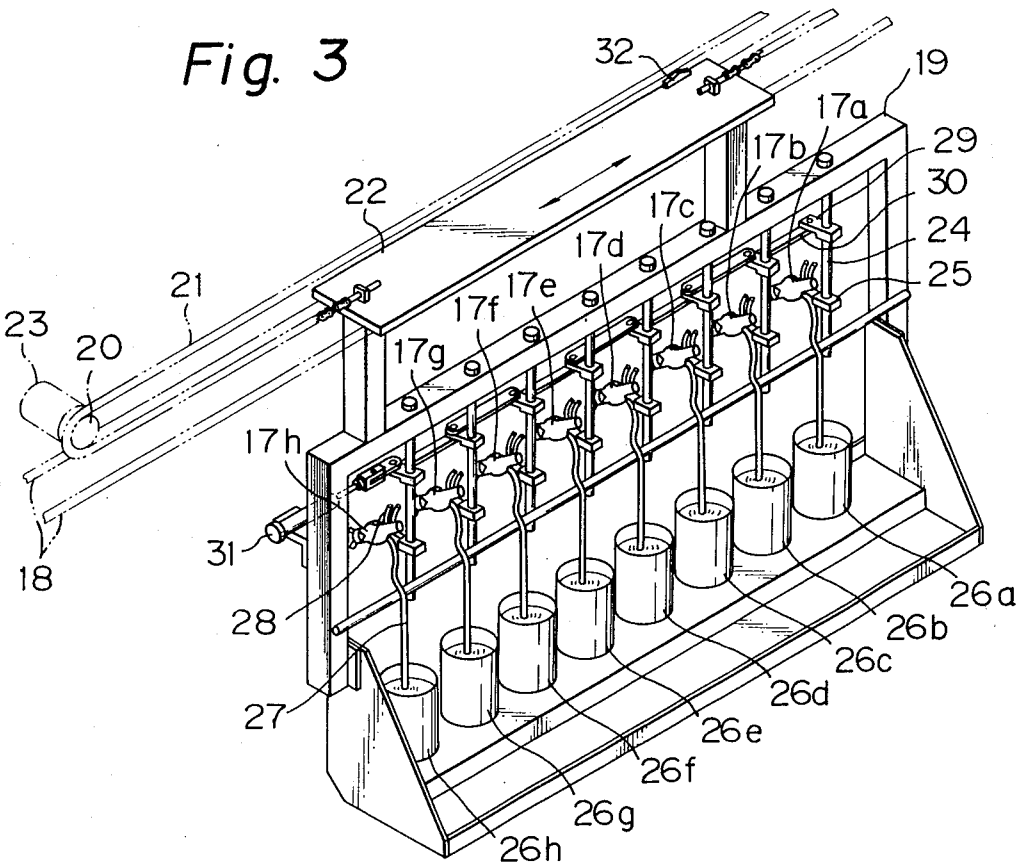
FIG. 3 is a perspective view showing the paint supply apparatus.

The paint supply apparatus of the present invention is provided to confront the painting station 12, as shown in FIG. 1. The paint supply apparatus includes spray guns 17*a* through 17*h* arranged in spaced, side-by-side relation and of a number equivalent to the number of barrels 7*a* through 7*h*. The spray guns 17*a* through 17*h* are adapted to be rectilinearly reciprocated in a direction perpendicular to the central axis about which the barrels 7*a* through 7*h* revolve, with the side-by-side relationship of the spray guns being maintained. The paint supply apparatus of the present invention will now be described in greater detail with reference to FIG. 3.

The apparatus includes a pair of horizontal guide rails 18, 18, a support frame 19 depending from the guide rails 18, 18, a chain 21 extending between and meshing with sprockets 20, 20 supported between the guide rails 18, 18 at both ends thereof, a travelling plate 22 constituting part of the support frame 19 and supported on the guide rails 18, 18, both ends of the chain 21 being fastened securely to the travelling plate 22, and a reversible third motor 23 connected to one of the sprockets 20. Rotating the third motor 23 back and forth causes the chain 21 meshing with the sprockets 20, 20 to run in one direction and then the other to reciprocate the support frame 19 along the guide rails 18, 18. The support frame 19 is provided with upstanding, freely rotatable support shafts 24 equidistantly spaced along the travelling direction of the support frame 19, the number of support shafts 24 being equivalent to the number of barrels 7*a* through 7*h*. Each support shaft 24 has an arm 25 projecting from an intermediate portion thereof, each arm 25 supporting a corresponding one of the spray guns 17*a* through 17*h*. The support frame 19 has a bottom on which are disposed paint cans 26*a* through 26*h* each containing a paint of a different color or type. The number of paint cans 26*a*–26*h* corresponds to the number of spray guns 17*a*–17*h*. A pipe 27 connects each paint can with the corresponding spray gun. Also connected to each spray gun is a corresponding air hose 28. Projectively provided on the upper portion of each support shaft 24 is a crank 29. The cranks 29 are interconnected by respective links 30. Connected to an endmost one of the links 30 is a cylinder 30 which, by being actuated, causes the spray guns to yaw from side to side.

Figure 4:
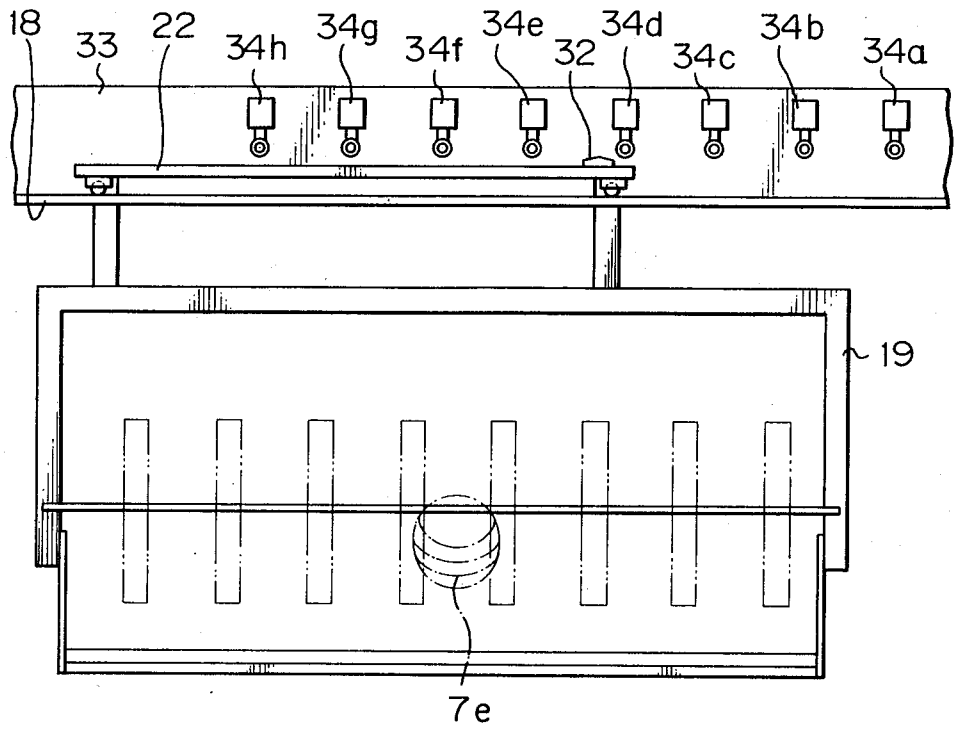
FIG. 4 is a front view showing part of a control unit included in the apparatus of FIG. 3.

The paint supply apparatus includes a control unit 37 for bringing one of the spray guns 17*a*–17*h* into opposition with whichever one of the barrels 7*a*–7*h* is situated in the painting station 12. As shown in FIG. 4, a chevron-shaped contacting element 32 is secured to the upper side of the travelling plate 22 of support frame 19, a stationary plate 33 is provided along the guide rails 18, and limit switches 34*a*–34*h*, the number of which is equal to the number of spray guns 17*a*–17*h*, are mounted in spaced-apart relation on the stationary plate 33. The spacing of the limit switches 34*a*–34*h* is identical with that of the spray guns 17*a*–17*h*. As shown in FIGS. 1 and 2, the upper surface of the turntable 2 is provided with a limit switch 35. Projectively provided on the underside of the stationary table 4 in angularly spaced relation are pins 36, the number of which is equal to the number of barrels 7*a*–7*h*. The pins are arranged in such a manner that their spacing corresponds to the spacing of the barrels and so as to contact the limit switch when the turntable 2 rotates.

Figure 5:
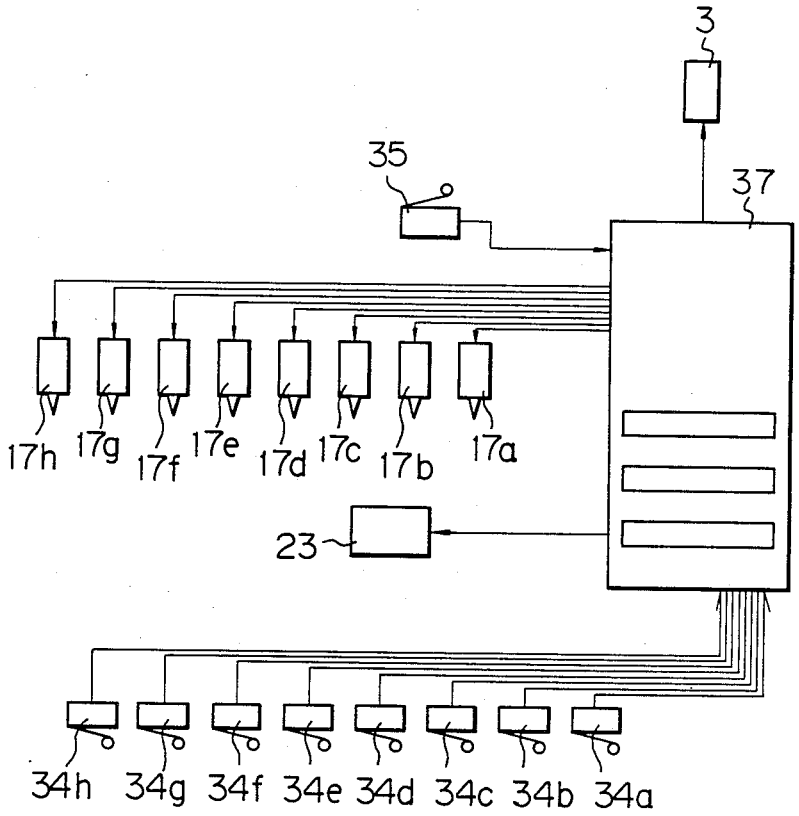
FIG. 5 is a control block wiring diagram of the same.

As shown in FIG. 5, the control unit 37 controls the first motor 3 in response to a signal from the limit switch 35 on turntable 2 in such a manner that the turntable 2 is intermittently rotated or indexed by an incremental amount equivalent to the angular spacing between adjacent barrels. The control unit 37 controls the third motor 23 in response to signals from the array of limit switches 34*a*–34*h* to bring an appropriate one of the spray guns 17*a*–17*h* to the painting station 12, where the selected spray gun is made to spray paint for a predetermined period of time toward the barrel located in the painting station, the paint being drawn from the corresponding one of the paint cans 26*a*–26*h*. The number of times paint is to be sprayed by the spray gun can also be controlled. It should be noted that the electric circuitry constituting the control unit 37 may be of an ordinary configuration and the details thereof need not be described here.

According to the illustrated embodiment, indexing the barrels 7*a*–7*h* by one angular increment is sensed by the limit switch 35, which responds by delivering an output signal to the control unit 37. The latter in turn responds by causing the third motor 23 to move the support frame 19, thereby shifting the spray guns 17*a*–17*h* by a distance, referred to hereinafter as one "pitch", equivalent to the spacing between adjacent spray guns so that the parts accommodated in each barrel can be sprayed with paint of a color different from the colors of the paints sprayed on the parts in the other barrels. More specifically, as shown in FIG. 1, assume that barrel 7*g* is presently located in the painting station 12, and that paint of a designated color is sprayed toward the barrel 7*g* from spray gun 17*g* for a predetermined period of time. Next, barrel 7*h* is indexed into the painting station 12 by rotating the turntable 2 through one angular increment. When the barrel 7*h* arrives at the painting station 12, the support frame 19 is moved by one pitch to shift the endmost spray gun 17*h* into position opposite barrel 7*h* in spray station 12 so that the parts in barrel 7*h* may be sprayed with paint of a color different from the color of the paint coating the parts in barrel 7*g*. This ends one painting cycle. If it is desired to repeat the painting cycle, the turntable 2 is rotated through one angular increment to index barrel 7*a* into the painting station 12, at which time the support frame 19 is moved in the reverse direction to bring the first or rightmost spray gun 17*a* into position opposite the painting station 12. Thus, the arrangement is such that any given barrel is always sprayed with paint of the same color.

It should be noted that the amount of movement of support frame 19 can be adjusted by changing the setting of the limit switches 34*a*–34*h*. Furthermore, the barrels are rotated about their respective axes during the painting operation and paint is sprayed from the spray gun at the painting station 12 while the spray gun is caused to yaw or swing back and forth a predetermined number of times by actuating the cylinder 31.

Thus, the paint supply apparatus of the present invention operates by intermittently revolving a number of radially extending barrels arranged in angularly spaced relation to successively index each one of the barrels into a painting station, and successively shifting spray guns, each of which is capable of ejecting a different colored paint, to the painting station so that the batch of parts in each barrel may be sprayed with paint different from the color of the paints used to spray-coat the part in the other barrels. To this end, the paint supply apparatus is provided with spray guns the number whereof is equivalent to the number of barrels, and the barrels and spray guns are sequentially shifted to the painting station in the order in which they are arrayed. Therefore, even if there are a large number of barrels in an array, each barrel can be supplied with the predetermined paint in reliable fashion without error. Moreover, when a painting cycle is repeated, each individual barrel can be supplied again and again with the paint prescribed for the barrel, namely with paint of the same type. The present invention makes possible a multicolored painting operation with one and the same apparatus and is therefore very useful in painting small lots of parts in colors which differ from one lot to another.

As many apparently widely different embodiments of the present invention can be made without departing from the spirit and scope thereof, it is to be understood that the invention is not limited to the specific embodiments thereof except as defined in the appended claims.

What is claimed is:

1. A paint supply apparatus for a rotary painting machine having a revolvable turntable, a plurality of angularly spaced, radially extending barrels made of wire mesh mounted on a circumferential portion of said turntable and having respective axes of rotation, each of said barrels being receptive of a batch of parts, and a painting station, a setting station, a baking and drying station and a cooling station successively disposed around said turntable, wherein a batch of parts introduced into said barrels is painted by passing each of said barrels through each of said stations while each barrel is being rotated about its axis of rotation as said turntable is intermittently revolved by a single pitch equivalent to the angular spacing between mutually adjacent ones of said barrels, said paint supply apparatus comprising paint spray guns the number whereof is equivalent to the number of said barrels, a support frame on which said paint spray guns are supported in spaced side-by-side relation, and means for intermittently moving said support frame at said painting station by a single pitch equivalent to the spacing between mutually adjacent ones of said paint spray guns in synchronism with incremental revolution of said barrels, each of said barrels being supplied with a predetermined paint sprayed from one of said paint spray guns.

2. The paint supply apparatus according to claim 1, wherein said support frame carries paint cans the number whereof is equivalent to the number of said paint spray guns, each spray can being connected with a corresponding one of said paint spray guns.

* * * * *